US005758391A

United States Patent [19]

Donner et al.

[11] Patent Number: 5,758,391

[45] Date of Patent: Jun. 2, 1998

[54] COUPLING PIECE FOR THE DETACHABLE CONNECTION OF CONTAINERS

[75] Inventors: Julius Donner, Lemwerder; Thomas Niemann, Delmenhorst; Wilhelm Wilk, Bremen, all of Germany

[73] Assignee: MacGregor-Conver GmbH, Bremen, Germany

[21] Appl. No.: 776,516

[22] PCT Filed: Aug. 2, 1995

[86] PCT No.: PCT/EP95/03070

§ 371 Date: Apr. 9, 1997

§ 102(e) Date: Apr. 9, 1997

[87] PCT Pub. No.: WO96/06026

PCT Pub. Date: Feb. 29, 1996

[30] Foreign Application Priority Data

Aug. 19, 1994 [DE] Germany ..... 44 29 358.5
Feb. 13, 1995 [DE] Germany ..... 195 04 635.8

[51] Int. Cl.[6] ..... B65D 90/00

[52] U.S. Cl. ..... 24/287

[58] Field of Search ..... 410/82; 24/287, 24/265 CD, 592–595

[56] References Cited

FOREIGN PATENT DOCUMENTS 2632530 1/1978 Germany .
3710419 10/1988 Germany .
3809834 11/1988 Germany .
4030140 3/1992 Germany .
4133498 4/1993 Germany .
WO8807006 9/1988 WIPO .
WO9205093 4/1992 WIPO .

*Primary Examiner*—James R. Brittain
*Attorney, Agent, or Firm*—Sughrue, Mion, Zinn, Macpeak & Seas, PLLC

[57] ABSTRACT

Coupling piece for the detachable connection of corner fittings of containers stacked one above the other on board ships. Work to reduce the manual effort involved in coupling together the containers, often semi-automatically. The satisfactory operation of such coupling pieces depends essentially upon the observance of various operating specifics. If this is not done, malfunctions will result.

The coupling piece according to the invention is intended to be able to be operated in a simple and error-free manner in order to avoid such malfunctions. To this end, an actuating device (22) for twisting the locking bolt (21) displaying crossbolts (32, 33) for connecting the containers is provided with a rope (49) displaying two pull cords (57, 58), which rope is connected centrally to the locking bolt (21). As a result of the two pull cords (57, 58), it is possible to twist the locking bolt (21) both clockwise and anti-clockwise. In this way, on the one hand, operating errors are able to be wiped out, on the other hand the coupling piece is able to be disposed with both the upper and lower crossbolt (32) between the containers to be connected. Finally, it is also possible to detach the connection of the containers in a targeted manner, so that, according to choice, the coupling piece remains situated on the lower container or can be raised with the upper container from the lower container.

13 Claims, 6 Drawing Sheets

COUPLING PIECE FOR THE DETACHABLE CONNECTION OF CONTAINERS

BACKGROUND OF THE INVENTION

The invention relates to a coupling piece for the detachable connection of corner fittings of adjacent containers, especially of containers stacked one above the other on board ships, according to the preamble of claim 1 and 9 respectively.

Coupling pieces of the type stated at the beginning are usually referred to in the jargon of the trade as "twistlocks". These coupling pieces are predominantly used to join together containers which are to be transported on board ships. Relative displacements of the containers during marine transport are thereby intended to be prevented.

In order to minimize the manual activities involved in locking and unlocking the coupling pieces and hence to reduce costly lay times of ships in ports, semi-automatic coupling pieces are used. These are pre-locked manually to one of the containers to be connected. A definitive locking is automatically carried out once the containers to be connected have been placed one on top of the other. When unloading, in order to detach the connected containers, the coupling piece has to be actuated manually. From WO 8807006 A1, a coupling piece is known which has an actuating device displaying a single pull rope. This pull rope has the drawback however that the coupling piece can only be used in a certain relative arrangement to the containers to be connected. An incorrect arrangement of the coupling piece results in a definitive locking not being automatically realized. A further drawback consists in the fact that the known coupling piece, should it be inadvertently unlocked, can no longer be locked. Finally, nor is it possible for this coupling piece to be uncoupled, according to choice, from the upper or lower container.

SUMMARY OF THE INVENTION

The object of the invention is therefore to provide a universally employable, coupling piece which ensures simple, error-free operation.

A coupling piece for achieving this object displays the features defined in claim 1. As a result of the actuating device provided according to the invention with two pull cords, it is possible to twist the locking bolt in opposite directions. Operating errors and, in particular, incorrectly realized lockings can be avoided or wiped out with the coupling piece according to the invention by the pull cords which are present in duplicate. In addition, the coupling piece according to the invention is universally employable.

Preferably, the two pull cords are formed from (half-length) portions of a single flexurally slack or flexurally elastic actuating means, for example a rope or a rope-like cord. Opposite ends of the actuating means are provided with a respective actuating end. It is also possible to use two separate, shorter actuating means for the creation of each pull cord. In this case, one free end of each actuating means has its own actuating end.

A further coupling piece for achieving the object forming the basis of the invention displays the features defined in claim 9. Accordingly, the crossbolts of the locking bolt are of essentially identical configuration. Because of this, there is no need to take care to ensure that the coupling piece is pre-locked with a certain crossbolt to one of the containers to be connected. Rather, the coupling piece can be optionally revolved, namely can be pre-locked both with the upper and with the lower crossbolt to one of the containers. The requirements placed upon the operation of semi-automatic coupling pieces using optional actuating means are thereby able to be simplified in a surprisingly simple manner. Particularly in connection with a coupling piece of the above-described claims, which coupling piece displays an actuating device having two pull cords, such a simple-to-operate coupling piece is obtained, in which operating errors are virtually precluded and unlocking by selective detachment of the coupling piece from the upper or lower container is ensured. Insofar as operating errors are made, these can be wiped out again without difficulty using the coupling piece according to the invention.

Further subclaims relate to preferred refinements of the coupling piece.

A preferred illustrative embodiment of the coupling piece according to the invention is explained in greater detail below with reference to the drawing, in which:

DESCRIPTION OF THE PREFERRED EMBODIMENTS

The coupling piece which is here shown serves the semi-automatic connection of containers stacked one on top of the other, which are not represented in the figures. The coupling piece is essentially composed of a housing 20, a locking bolt 21, an actuating device 22 and a fixing device 23.

Figure 2:
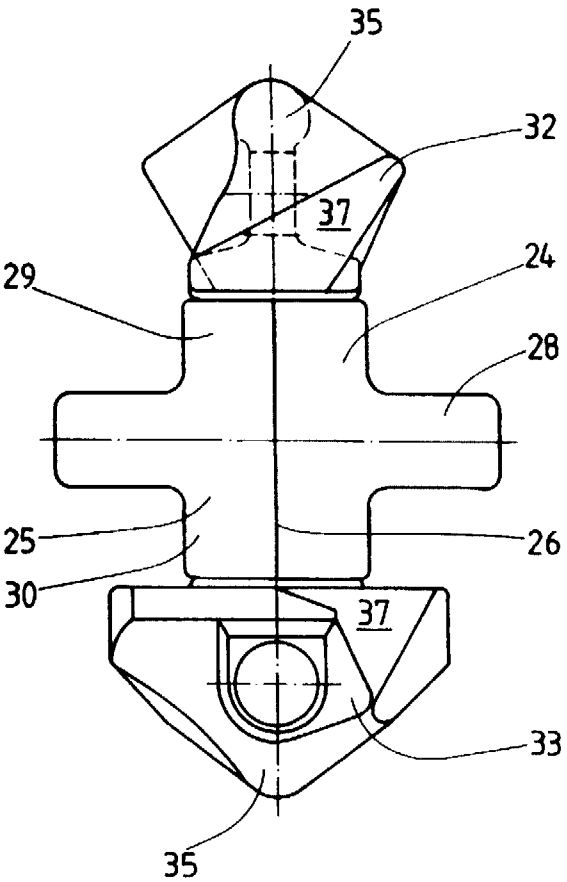
FIG. 2 shows a side view of the coupling piece, which side view is twisted by 90° relative to FIG. 1.
Figure 1:
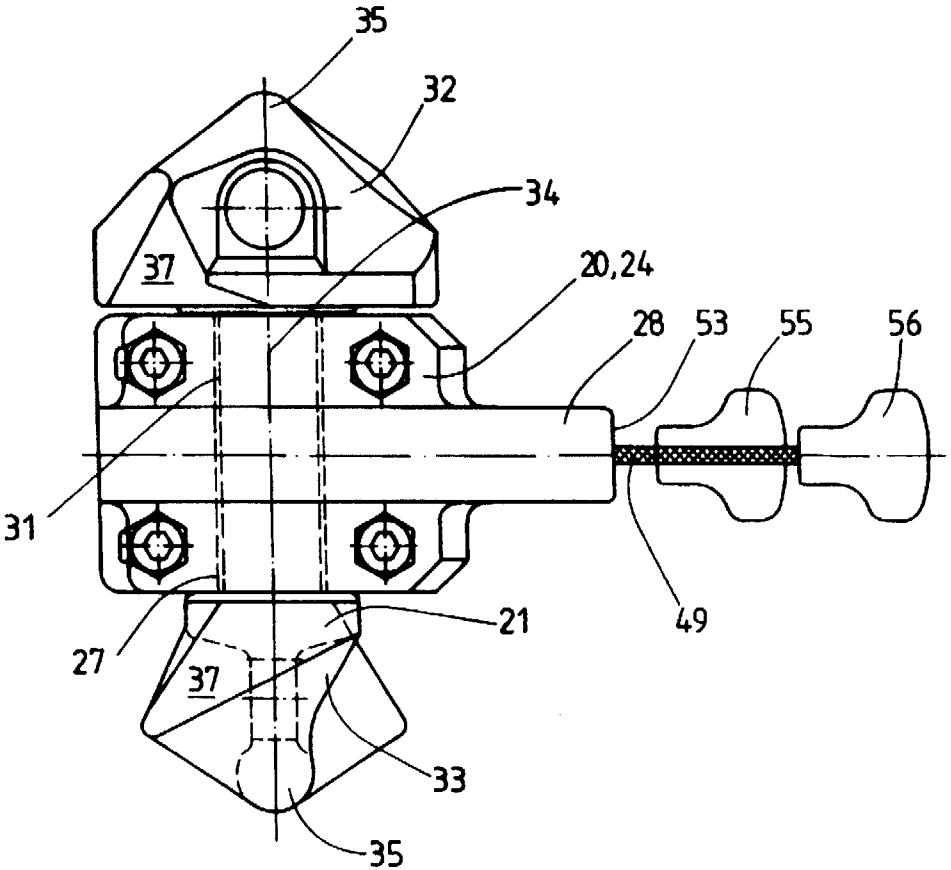
FIG. 1 shows a side view of the coupling piece.

The housing 20 of the coupling piece which is here shown is configured in two parts. It comprises two housing halves 24 and 25, which are screwed together in a central partition plane 26. The partition plane 26 runs longitudinally through the middle of a through bore 27 in the housing 20. The partition plane 26 and the through bore 27 run, in relation to that usage position of the coupling piece shown in FIGS. 1 and 2, vertically through the housing 20.

The outer part of the housing 20 is divided into three portions, namely into a central counter-bearing 28, which, when containers are stacked one on top of the other, comes to lie between adjacent corner fittings of the containers (not shown) as a spacer, and two middle pieces 29 and 30 disposed on opposite sides of the counter-bearing 28. The middle pieces 29 and 30 jut, when the containers are coupled together, into corresponding long holes in the corner fittings of containers lying one above the other.

The locking bolt 21 is composed of an essentially cylindrical middle part 31 and two crossbolts 32 and 33. The locking bolt 21 is configured in one piece, for which purpose the crossbolts 32 and 33 are formed onto opposite ends of the middle part 31. With the middle part 31, the locking bolt 21 is mounted rotatably about its longitudinal centre axis 34 in the through bore 27 of the housing 20. The two crossbolts 32 and 33 jut out of opposite ends of the housing 20. The crossbolts 32 and 33 are thereby located above the respective middle piece 29 and 30 of the housing.

Figure 12:
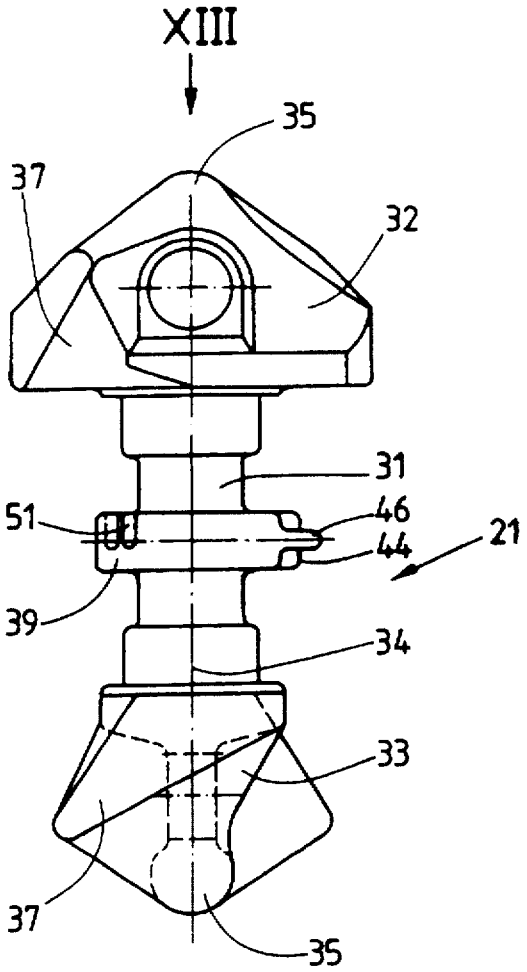
FIG. 12 shows a side view of a locking bolt of the coupling piece.
Figure 13:
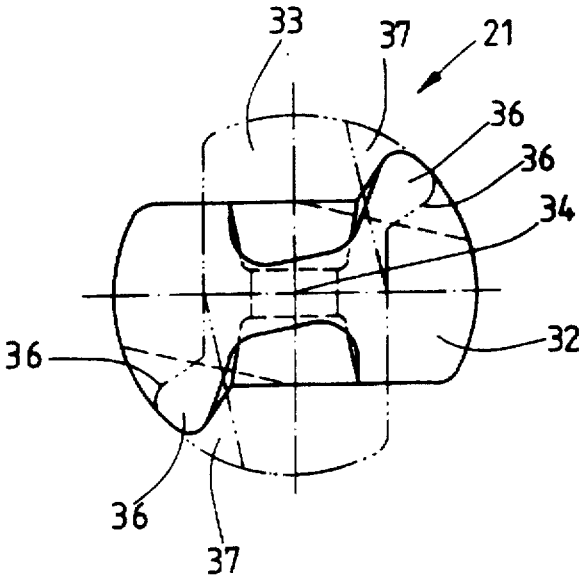
FIG. 13 shows a view XIII of the locking bolt.

The two crossbolts 32 and 33 of the locking bolt 21 are configured, according to the invention, essentially identically. Each of the crossbolts 32 and 33 has, on its (rear) side pointing to the respective middle piece 29 and 30 of the housing 20, an approximately rectangular base surface (FIG. 12). Starting therefrom, each crossbolt 32, 33 tapers conically towards its free end, which consequently displays a flat tip 35. On the parallel, long sides of each crossbolt 32 and 33 there are disposed diagonally opposing projections 36. These protrude in some regions relative to the rectangular base surface of each crossbolt 32, 33 (FIG. 13). The top sides of the projections 36 run obliquely to the tip 35 of the respective crossbolt 32, 33. The crossbolts 32, 33 thereby acquire a spiral running from the tip 35 to the projections 36. The bottom sides of the projections 36 are provided, in respect of each crossbolt 32 and 33, with bevels 37. The bevels 37 and the spiral of the top side of each crossbolt 32 and 33 have a pitch which is chosen such that, in certain positions of the respective crossbolt 32 and 33 relative to the corner fitting of the corresponding container, the crossbolt in question automatically twists the locking bolt 21 as it is inserted into the corner fitting or as it is pulled out of the corner fitting.

Furthermore, it is envisaged according to the invention that the one crossbolt 32 is offset relative to the other crossbolt 33, to be precise by approximately 90° (FIG. 13). Whenever, accordingly, the coupling piece is revolved, so that the lower crossbolt 33 is on top, and then the locking bolt 21 is twisted by 90° about the longitudinal centre axis 34, the originally lower crossbolt 33 makes its way into a position in which the previously upper crossbolt 32 was located.

Figure 3:
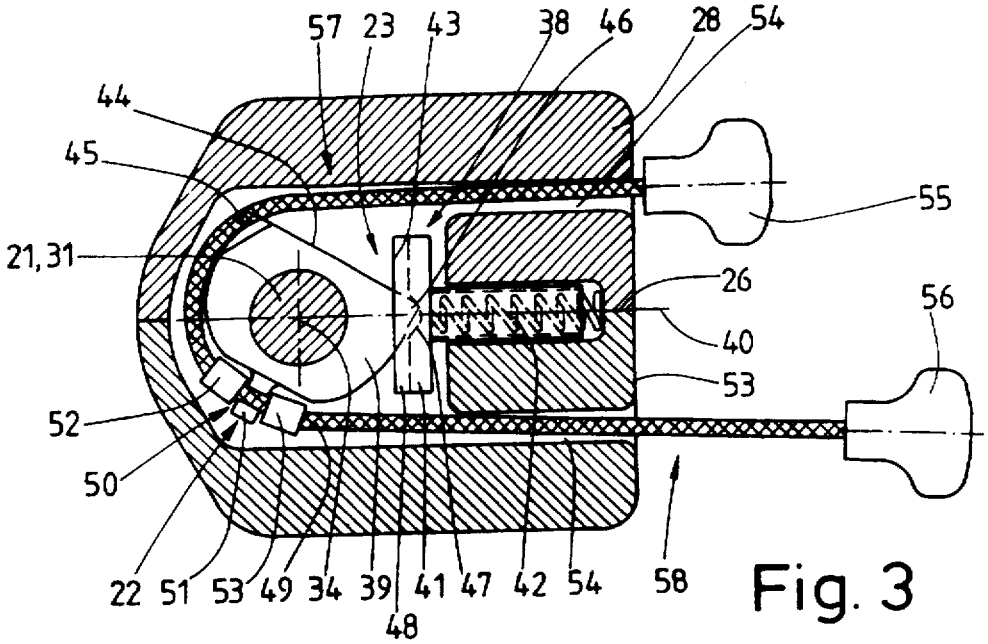
FIG. 3 shows a central horizontal section through the coupling piece, the upper crossbolt being unlocked.
Figure 6:
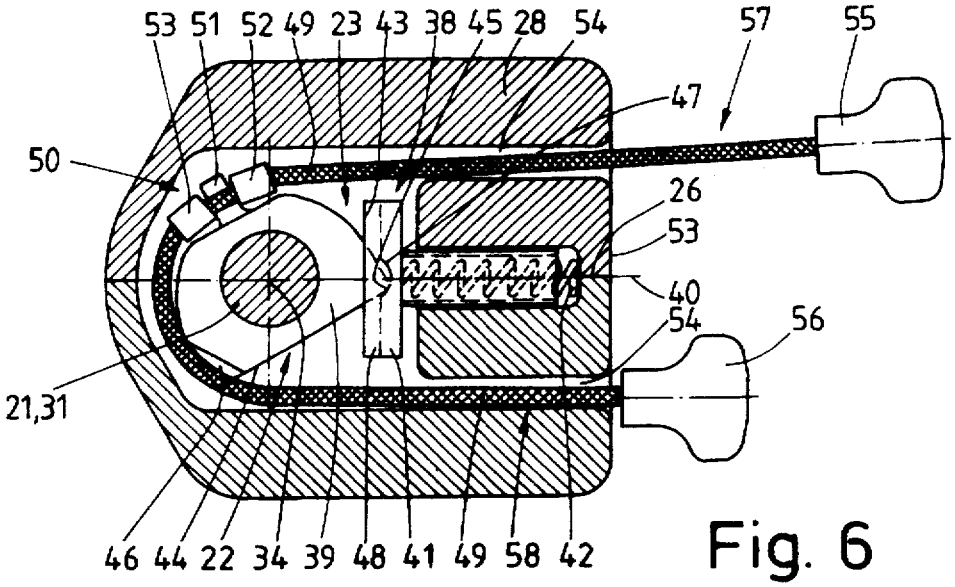
FIG. 6 shows a central horizontal section through the coupling piece pre-locked with the upper crossbolt.
Figure 9:
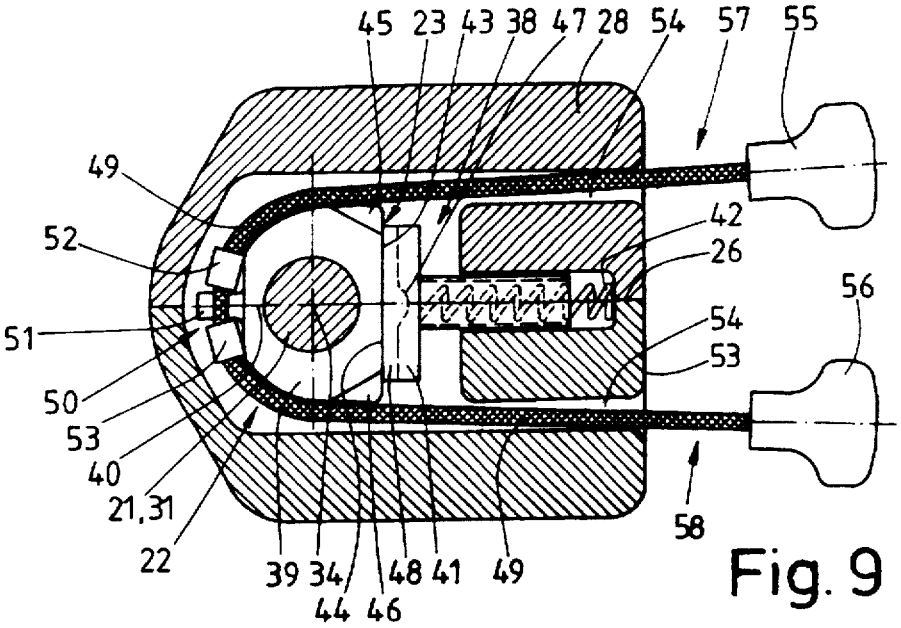
FIG. 9 shows a central horizontal section through the definitively locked coupling piece.

Inside the housing 20 there is disposed a fixing device 23, which fixes the locking bolt 21 in the three different settings according to FIGS. 3, 6 and 9. The fixing device 23 is composed of a spring-loaded ram 38 mounted in the housing 20 and a link plate 39 assigned to the locking bolt 21, which link plate corresponds with the ram 38. The link plate 39 is mounted non-twistably on the middle part 31 of the locking bolt 21 and can therefore be twisted together with the locking bolt 21. The spring-loaded ram 38 is displaceable on a transverse centre axis 40, which runs centrally through the counter-bearing 28 of the housing 20 and perpendicularly intersects the longitudinal centre axis 34 of the locking bolt 21. A ram plate 41 of the spring-loaded ram 38 is pretensioned by a spring, namely a pressure spring 42, in the direction of the locking bolt 21. A front stop face 43 of the ram plate 41, which stop face perpendicularly intersects the transverse centre axis 40, is thereby forced against the link plate 39.

Figure 10:
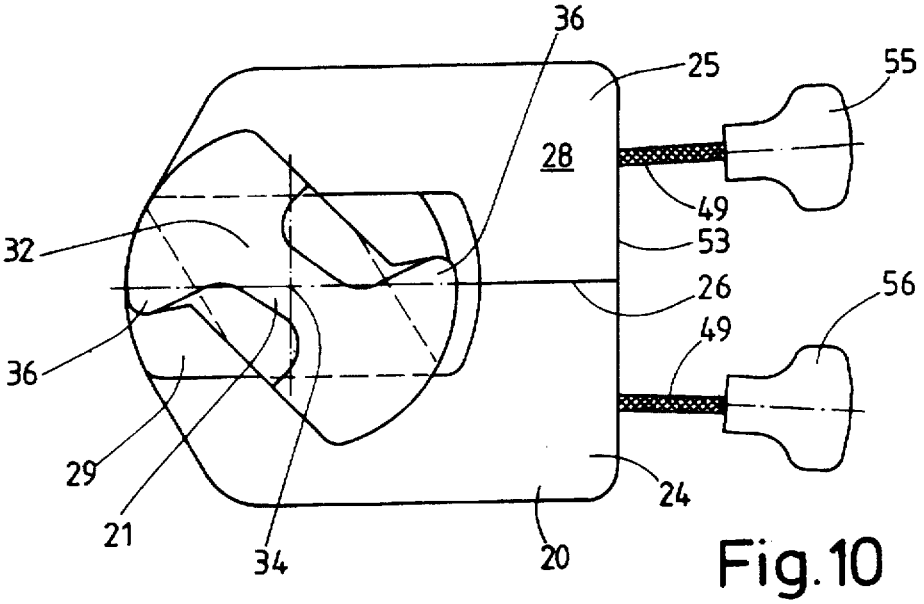
FIG. 10 shows a top view of the upper crossbolt of the definitively locked coupling piece of FIG. 9.
Figure 11:
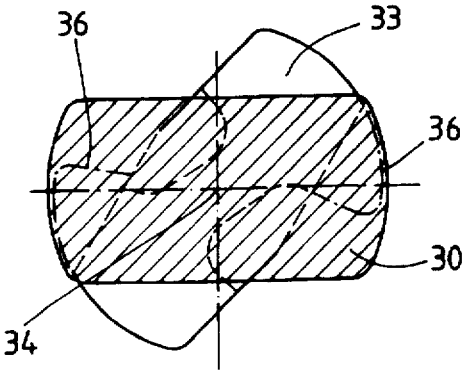
FIG. 11 shows a view of the lower crossbolt of the definitively locked coupling piece in a viewing direction analogous to FIG. 10.

Whenever the locking bolt 21 of the coupling piece is in the definitive locking setting according to FIG. 9, which connects the two adjacent containers and in which both crossbolts 32 and 33 are out of convergence with the middle pieces 29 and 30 on the housing 20 (FIGS. 10 and 11), a stop face 44 of the link plate 39 bears against the stop face 43 of the ram plate 41. The spring-loaded ram 38, with the assistance of the link plate 39, thereupon fixes the locking bolt 21 in the definitive locking setting of the coupling piece (FIG. 9).

At both opposite ends of the stop face 44, the link plate 39 respectively has a protruding boss 45 and 46. In the pre-locked setting of the coupling piece, when the upper crossbolt 32 is out of convergence with the middle piece 29 of the housing 20 (FIGS. 6 and 7) but the lower crossbolt 33, apart from the projections 36, coincides with the middle piece 30 of the housing 20, the boss 45 of the link plate 39 lies in bearing contact in a central depression 47 of a groove 48 in the stop face 44 of the ram plate 41 (FIG. 6). The locking bolt 21 of the coupling piece is thereby fixed in the pre-locked setting. In contrast, the opposite boss 46 of the ram plate 41 lies in bearing contact in the depression 47 of the groove 48 of the ram plate 41 (FIG. 3) whenever the upper crossbolt 32 is in its unlocked setting (FIG. 4) but the lower crossbolt 33 is locked (FIG. 5).

The actuating device 22 has, according to the invention, two flexurally elastic and/or flexurally slack pull cords 57 and 58. The two pull cords 57 and 58 are formed from a single actuating means, which is configured, in the illustrative embodiment shown, as a continuous rope 49. In each case, approximately one half of the rope 49 forms a pull cord 57 and 58 respectively. A middle region of the rope 49, which joins together the pull cords 57 and 58, is connected at a junction point 50 to the link plate 39 of the locking bolt 21. To this end, the rope 49 is guided through a transversely directed eyelet 51 on the rear side of the ram plate 41 pointing away from the stop face 44 and on the opposite sides of the eyelet 51 is fixed, such that it is non-displaceable in the longitudinal direction, by a respective thickening in the form of a press sleeve 52 on the rope 49. In this way, pulling on one end of that portion of the rope 49 which forms the one pull cord 57 enables the locking bolt 21 to be twisted clockwise and pulling on the opposite end of the rope 49, namely on the pull cord 58, enables it to be twisted anticlockwise.

The equal-length pull cords 57 and 58 of the rope 49, which extend to both sides of the eyelet 51, are guided out of the housing 20 through a flat lateral face 53 of the counter-bearing 28. For this purpose, on opposite sides of the transverse centre axis 40 there are disposed in the counter-bearing 28 of the housing 20 through-bores 54, which correspond with the pull cords 57 and 58 respectively. The through-bores 54 run parallel at respectively equal distance from the transverse centre axis 40 (FIGS. 3, 6 and 9). Ends of the pull cords 57 and 58, which ends jut out of the housing 20, are respectively configured as actuating ends. To this end, each of the two actuating ends is provided with a knob 55, 56. The coupling piece according to the invention consequently has two actuating ends, running symmetrically to the transverse centre axis 40, on each pull cord 57, 58, which can be manually operated by means of the knobs 55 and 56 respectively.

Figure 4:
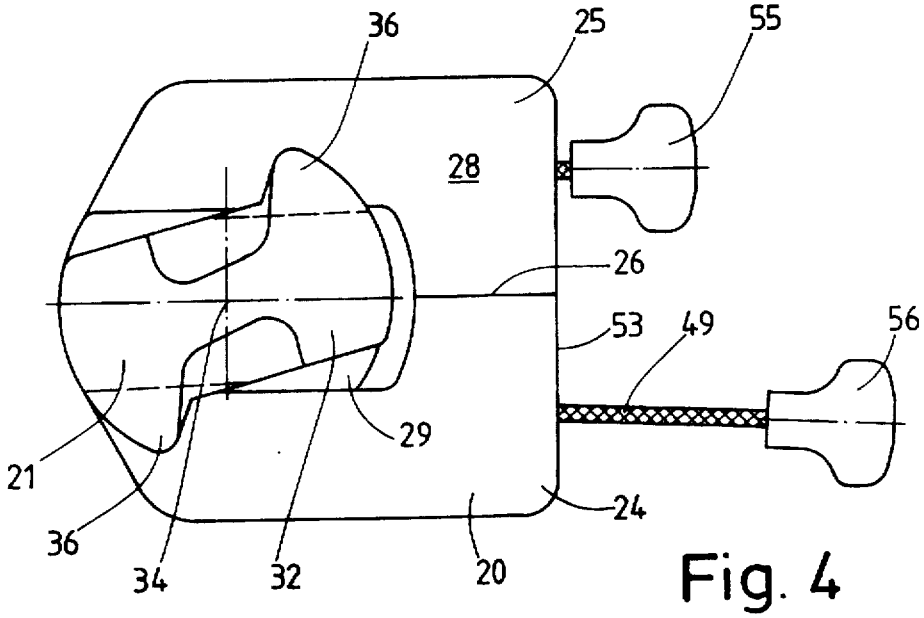
FIG. 4 shows the coupling piece of FIG. 3 in a top view of the upper crossbolt.
Figure 5:
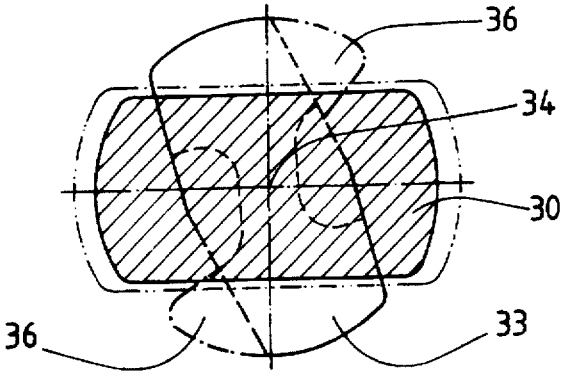
FIG. 5 shows the lower crossbolt of the coupling piece shown in FIGS. 3 and 4 in a viewing direction analogous to FIG. 4.
Figure 7:
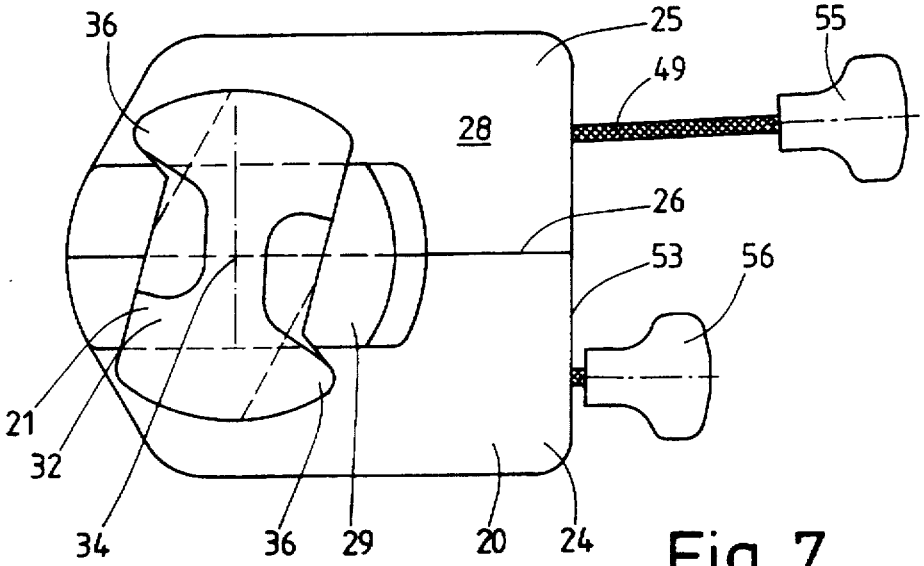
FIG. 7 shows a view of the pre-locked upper crossbolt of the coupling piece of FIG. 6.
Figure 8:
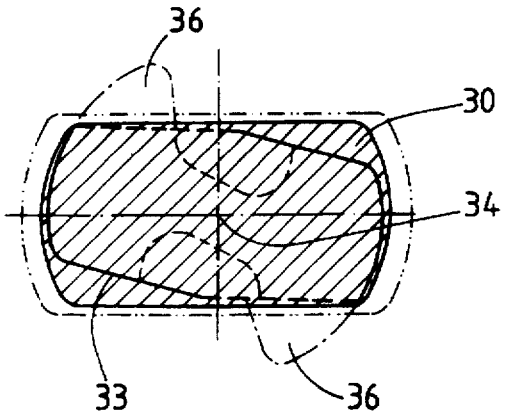
FIG. 8 shows a view of the lower crossbolt in the viewing direction analogous to FIG. 7.

By pulling on the respective actuating end, namely the knob 55 or the knob 56, the locking bolt 21 is twisted either clockwise or anti-clockwise. In concrete terms, the locking and unlocking operations proceed as follows:

By pulling on the knob 56, the coupling piece makes its way into the setting shown in FIGS. 3 to 5. The upper crossbolt 32 is herein in an unlocked setting for insertion into the lower corner fitting of an upper container. After this, by a pulling on the knob 55, the locking bolt 21 is twisted clockwise to the point where the upper crossbolt 32 is in a locked setting, but the lower crossbolt 33 assumes a setting which is suitable for insertion into the upper corner fitting of a lower container (FIGS. 6 to 8). When the coupling piece, which is pre-locked in this way beneath the upper container, is threaded into the corner fitting of the lower container, as a result of the diagonally opposing projections 36 on the lower crossbolt 33, the locking bolt 21 is twisted anti-clockwise into a position which enables the spring-loaded ram 38, once the upper container has been fully set down on the lower container, to twist the locking bolt further anti-clockwise into the position shown in FIGS. 9 to 11. In this position, the coupling piece is definitively bolted, in that both crossbolts 32, 33 are in a locking position and this is fixed by bearing contact of the stop face 43 of the spring-loaded ram 38 against the stop face 44 of the link plate 39 on the locking bolt 21 (FIG. 9).

In order to detach the connection of the containers, the coupling piece according to the invention admits two alternatives.

According to a first alternative, by pulling on the knob 55, the locking bolt 21 is twisted clockwise into the position shown in FIGS. 6 to 8. In this position, the coupling piece can be pulled by the unlocked lower crossbolt 33 out of the upper corner fitting of the lower container, for which purpose the bevels 37 on that (bottom) side of the lower crossbolt 33 directed towards the housing 20 rotate the locating bolt back slightly anti-clockwise to allow the diagonally opposing projections 36 on the crossbolt 33 to be threaded out of the long hole of the corresponding corner fitting of the upper container. The coupling piece is in this case raised with the upper container from the lower container.

In the second alternative, the locking bolt, by pulling on the knob 56, is twisted anti-clockwise to the point where the unlocked upper crossbolt 32 can be pulled out of the lower corner fitting of the upper container. In this case, the upper container can be raised alone, the coupling piece, as a result of being anchored in the upper corner fitting, remaining on the lower container (FIGS. 3 to 5).

The two actuating ends or pull cords 57, 58 of the coupling piece according to the invention, which actuating ends are formed by the knobs 55 and 56, make it possible for a coupling piece which has been inadvertently opened by pulling on the knob 55 to be reclosable by pulling on the opposite knob 56, until all actuating ends or knobs 55, 56 have an approximately equal distance from the lateral face 53 of the housing 20 and the coupling piece thus makes its way into the definitive locking position shown in FIG. 9.

Furthermore, the identical configuration of the crossbolts 32, 33 and the relative arrangement of the crossbolts 32, 33 one to another, which is purposefully offset by 90°, in conjunction with the symmetrically configured housing 20 and the two pull cords 57, 58 jutting out of the housing at equal distance from the transverse centre axis 40, result in the coupling piece being able to be pre-locked with any crossbolt, i.e. both with the upper crossbolt 32 shown in the figures and, according to choice, with the lower crossbolt 33, in the lower corner fitting of an upper container. In the coupling piece according to the invention, operating errors are thus precluded.

Figure 14:
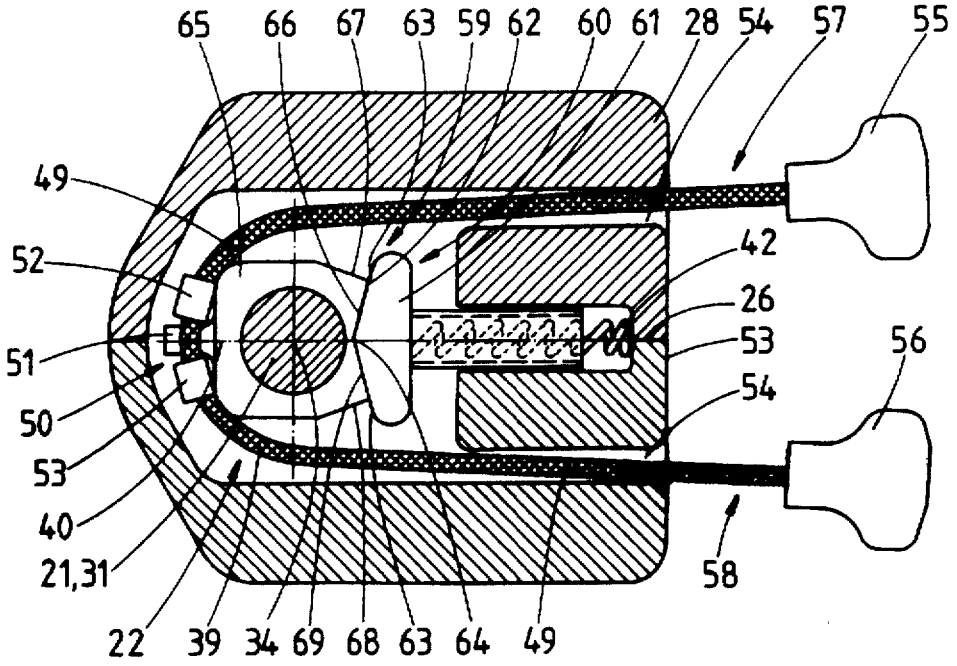
FIG. 14 shows a central horizontal section through a definitively locked coupling piece according to an alternative illustrative embodiment of the invention.
Figure 15:
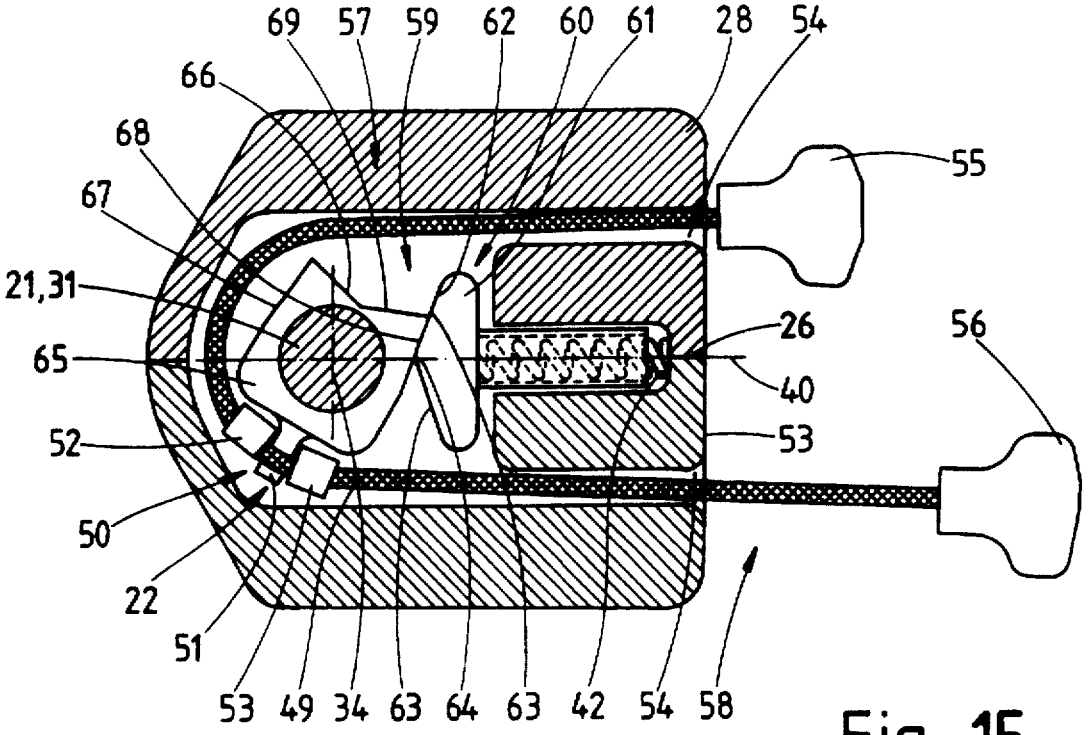
FIG. 15 shows a central horizontal section through the coupling piece of FIG. 14, the upper crossbolt being unlocked.

FIGS. 14 and 15 show a second illustrative embodiment of the coupling piece according to the invention. This differs from the coupling piece according to the first illustrative embodiment of FIGS. 1 to 13 by virtue of its fixing device. Otherwise, the coupling piece of FIGS. 14 and 15 corresponds to that of FIGS. 1 to 13, for which reason identical reference numerals are used for identical parts.

The fixing device 59 has a spring-loaded ram 60, the ram plate 61 of which displays a convex stop face 62. In concrete terms, the stop face 62 is of V-shaped configuration, in that it is composed of two part-faces 63 running at an obtuse angle of greater than 90° to each other. The two part-faces 63 meet on a vertical apex line 64, which lies on a vertical centre plane of the coupling piece, which plane runs through the longitudinal centre axis 34 of the locking bolt 21. The link plate 65 of the fixing device 59, which link plate corresponds with the spring-loaded ram 60, is connected non-twistably to the locking bolt 21 and has three stop faces 66, 67 and 68. The central stop face 66, when the coupling piece is definitively locked, bears fully against the stop face 62 of the spring-loaded ram 60 (FIG. 14). To this end, the stop face 66 is configured such that it corresponds to the V-shaped stop face 62 on the ram plate 61. Accordingly, the stop face 66 likewise has two part-faces 69, which run in a V-shape concavely to each other. At opposite sides of the stop face 66 there respectively adjoins one of the stop faces 67 and 68 respectively. When the upper crossbolt 32 is unlocked, the stop face 68 of the link plate 65 bears against a part-face 63 of the stop face 62 of the spring-loaded ram 60 (FIG. 15). A fixing of the locking bolt 21 consequently takes place, the upper crossbolt 32 being unlocked. Conversely, the opposite stop face 67 bears against a part-face 63 of the stop face 62 of the spring-loaded ram 60 whenever the lower crossbolt 33 is in an unlocked state.

In its operation, the coupling piece according to the second illustrative embodiment (FIGS. 14 and 15) corresponds to the coupling piece of the first illustrative embodiment of the invention (FIGS. 1 to 13). Reference is therefore made in full to the content of the working description relating to the coupling piece according to the first illustrative embodiment of the invention.

What is claimed is:

1. Coupling piece for the detachable connection of containers, especially of containers stacked one above the other on board ships, having a housing, a twistable locking bolt, which displays a middle part mounted rotatably in the housing and crossbolts disposed at opposite ends of the middle part, and having an actuating device for twisting the locking bolt, characterized in that the actuating device (22) displays at least two pull cords (57, 58) for twisting the locking bolt (21) in opposite directions.

2. Coupling piece according to claim 1, characterized in that each pull cord (57, 58) juts with an actuating end out of the housing (20).

3. Coupling piece according to claim 1, characterized in that each pull cord (57, 58) is connected to the locking bolt (21).

4. Coupling piece according to claim 1, characterized in that the pull cords (57, 58) are formed by a single actuating means.

5. Coupling piece according to claim 4, characterized in that the actuating means is fastened by a portion lying approximately centrally between the pull cords (57, 58) to the middle part (31) of the locking bolt (21).

6. Coupling piece according to claim 1, characterized in that the actuating device (22) displays two separate actuating means, in that each actuating means forms a pull cord (57 and 58).

7. Coupling piece according to claim 6, characterized in that each pull cord (57, 58) is fastened by its end opposite the actuating end to the middle part (31) of the locking bolt (21).

8. Coupling piece according to claim 4, characterized in that the actuating means, for the creation of the pull cords (57, 58), is configured as a rope (49).

9. Coupling piece for the detachable connection of containers, especially of containers stacked one above the other on board ships, having a housing, a twistable locking bolt, which displays a middle part mounted rotatably in the housing and cross bolts disposed at opposite ends of the middle part, and having an actuating device for twisting the locking bolt, wherein the actuating device (22) displays at least two pull cords (57, 58) for twisting the locking bolt (21) in opposite directions, characterized in that at least two crossbolts (32, 33) of the locking bolt (21) are of essentially identical configuration.

10. Coupling piece according to claim 9, characterized in that the crossbolts (32, 33) are offset by approximately 90° to one another.

11. Coupling piece according to claim 1 or 9, characterized in that the pull cords (57, 58) have respective actuating ends which jut out of the same lateral face (53) of a counter-bearing (28) of the housing (20) and lie at equal distance away on opposite sides of a centre plane of the housing (20) running through the longitudinal centre axis (34) of the locking bolt (21).

12. Coupling piece according to claim 1 or 9, characterized in that the locking bolt (21) displays a link plate (39; 65) situated in the housing (20) and having at least one stop face (44; 66, 67, 68) and the link plate (39; 65) is actively connected to a longitudinally displaceable, spring-loaded ram (38; 60) mounted in the housing (20).

13. Coupling piece according to claim 12, characterized in that the spring-loaded ram (38; 60) has a stop face (43; 62), which, in a locking position of both crossbolts (32, 33), corresponds with the stop face (44; 66) of the link plate (39, 65).

* * * * *